US007187889B2

(12) United States Patent
Yoshiyama

(10) Patent No.: US 7,187,889 B2
(45) **Date of Patent: *Mar. 6, 2007**

(54) GRID, SCOROTRON CHARGER HAVING THE GRID, PROCESS UNIT HAVING THE SCOROTRON CHARGER, AND IMAGE FORMING DEVICE INSTALLING THE PROCESS UNIT

(75) Inventor: Ikunobu Yoshiyama, Anjo (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/370,890

(22) Filed: Mar. 9, 2006

(65) Prior Publication Data

US 2006/0153594 A1 Jul. 13, 2006

Related U.S. Application Data

(63) Continuation of application No. 10/225,146, filed on Aug. 22, 2002, now Pat. No. 7,035,571.

(30) Foreign Application Priority Data

Aug. 23, 2001 (JP) ..... 2001-252898
May 31, 2002 (JP) ..... 2002-159558

(51) Int. Cl.
*G03G 15/02* (2006.01)

(52) U.S. Cl. ..... 399/171

(58) Field of Classification Search ..... 399/168, 399/171, 172; 361/213, 214, 225, 229; 250/324, 250/325, 326

See application file for complete search history.

(56) References Cited

U.S. PATENT DOCUMENTS

| | | | |
|---|---|---|---|
| 2,922,883 | A | 1/1960 | Giaimo |
| 3,960,444 | A | 6/1976 | Gundlach et al. |
| 4,020,315 | A | 4/1977 | Euler |
| 4,358,681 | A | 11/1982 | Ando |
| 4,563,076 | A | 1/1986 | Takahashi et al. |
| 4,652,754 | A | 3/1987 | Almeter et al. |
| 5,008,538 | A | 4/1991 | DeCecca et al. |
| 5,358,165 | A | 10/1994 | Andoh |
| 5,545,062 | A | 8/1996 | Takagishi et al. |
| 6,000,976 | A | 12/1999 | Takagishi et al. |

(Continued)

FOREIGN PATENT DOCUMENTS

JP 54143132 11/1979

(Continued)

*Primary Examiner*—Robert Beatty
(74) *Attorney, Agent, or Firm*—Oliff & Berridge, PLC

(57) ABSTRACT

A grid has a frame body in a U-shaped cross-section defining a main plate section and two side plate sections. A rectangular opening is formed at the main plate section, and a plurality of grid wires extend in a lengthwise direction of the main plate section and at one side thereof. Each end portion of each grid wire is soldered to each lengthwise end portion of the main plate section under tension. For providing a scorotron charger, a discharge wire is positioned opposite to the grid wires with respect to the main plate section, and each end of the discharge wire is fixed to the frame body in such a manner that the discharge wire extends in parallel with the grid wires.

19 Claims, 9 Drawing Sheets

U.S. PATENT DOCUMENTS

| | | | | |
|---|---|---|---|---|
| 6,144,826 | A | 11/2000 | Mitchell et al. | |
| 6,246,852 | B1 | 6/2001 | Branch et al. | |
| 6,303,933 | B1 | 10/2001 | Dickoff | |
| 6,330,410 | B1 | 12/2001 | Okabe et al. | |
| 6,512,904 | B2 * | 1/2003 | Sato et al. | 399/111 |
| 7,035,571 | B2 * | 4/2006 | Yoshiyama | 399/171 |

FOREIGN PATENT DOCUMENTS

| | | |
|---|---|---|
| JP | Y2 60-25068 | 7/1985 |
| JP | U 62-135142 | 8/1987 |
| JP | 1-88951 | 6/1989 |
| JP | 02-005764 | 1/1990 |
| JP | U 2-5764 | 1/1990 |
| JP | 05-074544 | 3/1993 |
| JP | 07-153522 | 6/1995 |
| JP | 08-030072 | 2/1996 |
| JP | 08-044154 | 2/1996 |
| JP | 08-139254 | 3/1996 |
| JP | 09062056 A | 3/1997 |
| JP | 10-171211 | 6/1998 |
| JP | 11097154 | 4/1999 |

* cited by examiner

GRID, SCOROTRON CHARGER HAVING THE GRID, PROCESS UNIT HAVING THE SCOROTRON CHARGER, AND IMAGE FORMING DEVICE INSTALLING THE PROCESS UNIT

This is a continuation of application Ser. No. 10/225,146 filed Aug. 22, 2002, now U.S. Pat. No. 7,035,571, which is hereby incorporated by reference in its entirety.

BACKGROUND OF THE INVENTION

The present invention relates to a grid assembled in a scorotron charger for charging a component to be charged, and to a scorotron charger having the grid. The present invention also relates to a process unit including the scorotron charger and the component to be charged, and to an image forming device incorporating the process unit.

In a conventional image forming device such as a laser printer, a charger, a scanner device, a developing device and image transfer device are provided in order in a rotating direction of a photosensitive drum as a component to be charged by the charger. After the surface of the photosensitive drum is uniformly charged by the charger in accordance with the rotation of the drum, the surface is exposed to scanned high speed laser beam from the scanner device to form an electrostatic latent image on the surface of the drum according to print data. The developing device has a developing roller whose surface is supplied with toners to form a thin toner layer on the surface. Upon rotation of the developing roller, the toner carried on the developing roller is supplied to the surface of the photosensitive drum to form a visible toner image on the surface of the photosensitive drum corresponding to the electrostatic latent image. Then, the visible image carried on the photosensitive drum is transferred onto a sheet when the sheet passes between the photosensitive drum and the image transfer device.

A scorotron charter having a discharge wire and grid electrodes is uses as the charger. Japanese Utility Model Application Kokai No. Hei-2-5764 and Japanese Utility Model Publication No. Sho-60-25068 disclose chargers in which wires are used as the grid electrodes. In the charger disclosed in Japanese Utility Model Application Kokai No. Hei-2-5764, a frame has longitudinal ends each provided with a plurality of upwardly projecting wire latching fingers spaced away from each other by a constant distance. One grid wire having one end fixed to the frame is alternately latched on each finger in a meandering fashion and another end of the grid wire is also fixed to the frame. Thus, a plurality of grid wires are set in parallel with each other. In the charger disclosed in Japanese Utility Model Publication No. Sho-60-25068, a pair of grid plates made from a resilient material are positioned spaced away from each other. Each grid plate is provided with fingers and pawls, whose numbers are equal to the numbers of grid wires. Each end of the grid wire is provided with a knot engaged with the pawls. One end of each wire is secured to each pawl of one grid plate, and other end of the wire is secured to each pawl of other grid plate riding over the fingers. Thus, a plurality of wires are fixed in parallel fashion to the grid plates.

However, in the disclosed chargers, formation of the fingers and pawls is costly, and it would be rather troublesome to latch or fix the wire(s) to the fingers and the pawls.

SUMMARY OF THE INVENTION

It is an object of the present invention to overcome the above-described problems and to provide an improved grid capable of easily fixing grid wires to a frame.

Another object of the present invention is to provide a scorotron charger having a compact size with the improved grid.

Still another object of the present invention is to provide a process unit having a compact size with the improved scorotron charger.

Still another object of the present invention is to provide an image forming device having a compact size with the improved process unit, and capable of performing high peed image formation.

Still another object of the present invention is to provide an improved method for producing the grid.

These and other objects of the present invention will be attained by a grid for use in a scorotron charger including a frame body formed with an opening, and a plurality of grid wires each extending over the opening and having end portions fixed to the frame body under tension.

In another aspect of the invention there is provided a scorotron charger for charging a component to be charged, the scorotron charger including the above described grid and a discharge wire positioned opposite to the component to be charged with respect to the plurality of grid wires.

In still another aspect of the invention there is provided a process unit including a drum cartridge detachable from a printer body. The drum cartridge includes a drum frame, a component to be charged supported by the drum frame, and, the above described scorotron charger assembled in the drum frame and positioned out of contact from the component to be charged.

In still another aspect of the invention, there is provided an image forming device for forming a visible image on an image recording medium including a main frame, and the process unit. The process unit includes the above described drum cartridge provided detachable from the main frame.

In still another aspect of the invention, there is provided a method for producing a grid including a frame body formed with an opening, and a plurality of grid wires each extending over the opening and having end portions fixed to the frame body under tension. The method includes bending step, forming step, placing step, bridging step, fixing step and cutting step. In the bending step, a flat plate is bent at at least one bending line to provide a main plate section having major sides and minor sides and at least one side plate section sectioned from the main plate section at the bending line to provide a frame body. In the forming step, a rectangular opening is formed at the main plate section simultaneously with the bending step. The rectangular opening has major sides extending in parallel with the bending line and minor sides in parallel with the minor sides of the main plate section. In the placing step, a jig is placed around the frame body. The jig has a pair of block bodies positioned outside of the minor sides of the main plate section. In the bridging step, a plurality of wires are bridged in parallel with the major side and over the main plate section between the block bodies under tension. In the fixing step, each end of the wire is fixed to the main plate section at positions between each minor side of the opening and each minor side of the main plate section. In the cutting step, each wire is cut at each end of the main plate section to form a plurality of grid wires.

BRIEF DESCRIPTION OF THE DRAWINGS

In the drawings:

FIG. 11(*b*) is a partial cross-sectional view showing the grid according to the fifth embodiment;

DETAILED DESCRIPTION OF THE PREFERRED EMBODIMENTS

Figure 1:
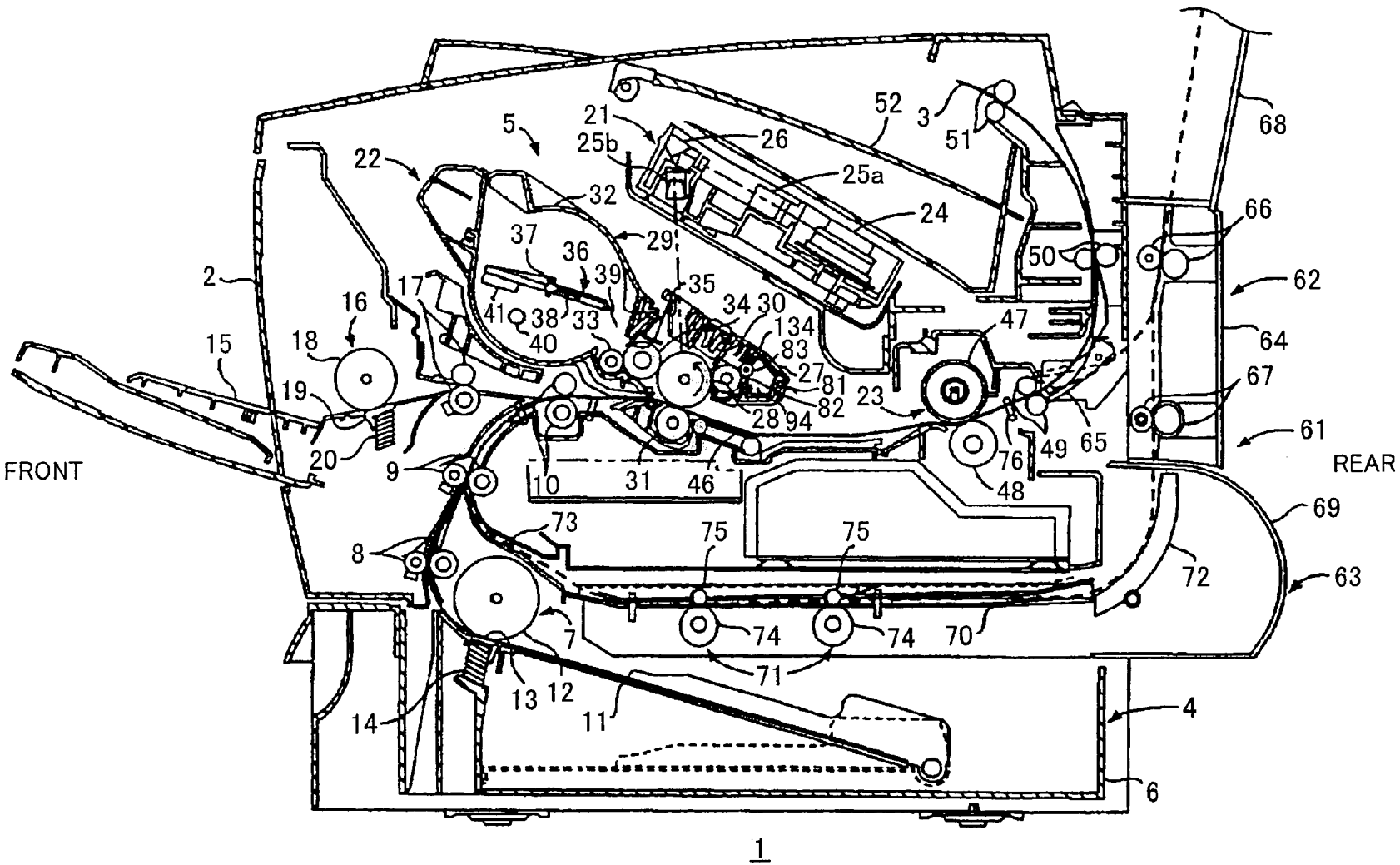
FIG. 1 is a side cross-sectional view showing a laser printer as an image forming device according to one embodiment of the present invention.

A laser printer according to a first embodiment of the present invention will be described with reference to FIGS. 1 through 7. The laser printer 1 is of an electro-photographic type printer using a non-magnetic single component type developing agent. The printer 1 includes a main casing 2, a feeder portion 4 for feeding a sheet 3 as an image recording medium, and an image forming portion 5 for forming an image on the fed sheet 3. These feeder portion 4 and the image recording portion 5 are installed in the casing 2.

The feeder portion 4 includes a sheet tray 6, a sheet feed mechanism 7, sheet feed rollers 8, 9 and a register roller 10. The sheet tray 6 is positioned on a bottom of the main casing 2 and is slidable with respect thereto so that the sheet tray 6 is detachable therefrom in a horizontal direction through an opening at a front wall of the main case 2. The sheet tray 6 is of a box shape with an upper open construction so as to accommodate therein a stack of sheets 3. A sheet mount plate 11 is disposed in the sheet tray 6 for mounting thereon the sheet stack. The sheet mount plate 11 has a rear end pivotally connected to the sheet tray 6 and a front free end movable in a vertical direction toward and away from the sheet feed mechanism 7. A compression spring (not shown) is provided below the sheet mount plate 11 for normally urging the sheet mount plate 11 upwardly. Therefore, if sheet stack amount on the sheet mount plate 11 is increased, the free end of the sheet mount plate 11 is pivotally moved downwardly about the rear pivot axis against the biasing force of the compression spring (not shown).

The sheet feed mechanism 7 is positioned at a sheet discharge end of the sheet tray 6, and includes a sheet supply roller 12, a separation pad 13 positioned in direct confrontation with the sheet supply roller 12, and a spring 14 disposed immediately below the separation pad 13 for normally urging the separation pad 13 toward the sheet supply roller 12. An uppermost sheet 3 on the sheet stack on the sheet mount plate 11 is urged toward the sheet supply roller 12 because of the biasing force of the compression spring associated with the sheet mount plate 11. The sheet feed rollers 8, 9 are disposed at a downstream side of the sheet feed mechanism 7 in a sheet feeding direction. The register roller 10 is disposed at a downstream side of the sheet feed rollers 8, 9. Upon rotation of the sheet supply roller 12, a leading end portion of the uppermost sheet is nipped between the sheet supply roller 12 and the separation pad 13. In this manner each uppermost sheet is separated from the sheet stack and is delivered to the register roller 10 by way of the sheet feed rollers 8 and 9. The register roller 10 includes a pair of rollers for correcting diagonal feeding of the sheet 3 so as to feed the sheet 3 in a correct orientation to the image forming position defined by a contacting area between a photosensitive drum 28 and a transfer roller 31 described later.

The feeder portion 4 also includes a multiple purpose tray 15 for stacking thereon a stack of a random size sheets 3, a multiple purpose sheet feed mechanism 16 for feeding the sheet on the multiple purpose tray 15, and a multiple purpose feed roller 17. The multiple purpose tray 15 is positioned at the front of the main casing 2. The multiple purpose sheet feed mechanism 16 includes a multiple purpose sheet supply roller 18, a multiple purpose separation pad 19 positioned in direct confrontation with the multiple purpose sheet supply roller 18, and a spring 20 disposed immediately below the multiple purpose separation pad 19 for normally urging the separation pad 19 toward the sheet supply roller 18. Upon rotation of the multiple purpose sheet supply roller 18, an uppermost sheet on the sheet stack on the multiple purpose tray 15 is nipped between the multiple purpose sheet supply roller 18 and the multiple purpose separation pad 19. In this manner each uppermost sheet is separated from the sheet stack and is delivered to the register roller 10 by way of the multiple purpose sheet supply roller 18.

The image forming portion 5 includes a scanner portion 21, a process unit 22 as a process device, and a fixing portion 23. The scanner portion 21 is disposed at an upper interior portion of the main casing 2, and includes a laser emitting portion (not shown), a rotatably driven polygon mirror 24, lenses 25*a* and 25*b*, and a reflection mirror 26. The laser beam subjected to modulation according to an image data is emitted from the laser emitting portion and is irradiated onto a surface of the photosensitive drum 28 of the process unit 22 through an optical path as shown by a dotted chain line defined by the polygon mirror 24, the lenses 25*a*, the reflection mirror 26 and the lens 25*b*.

Figure 2:
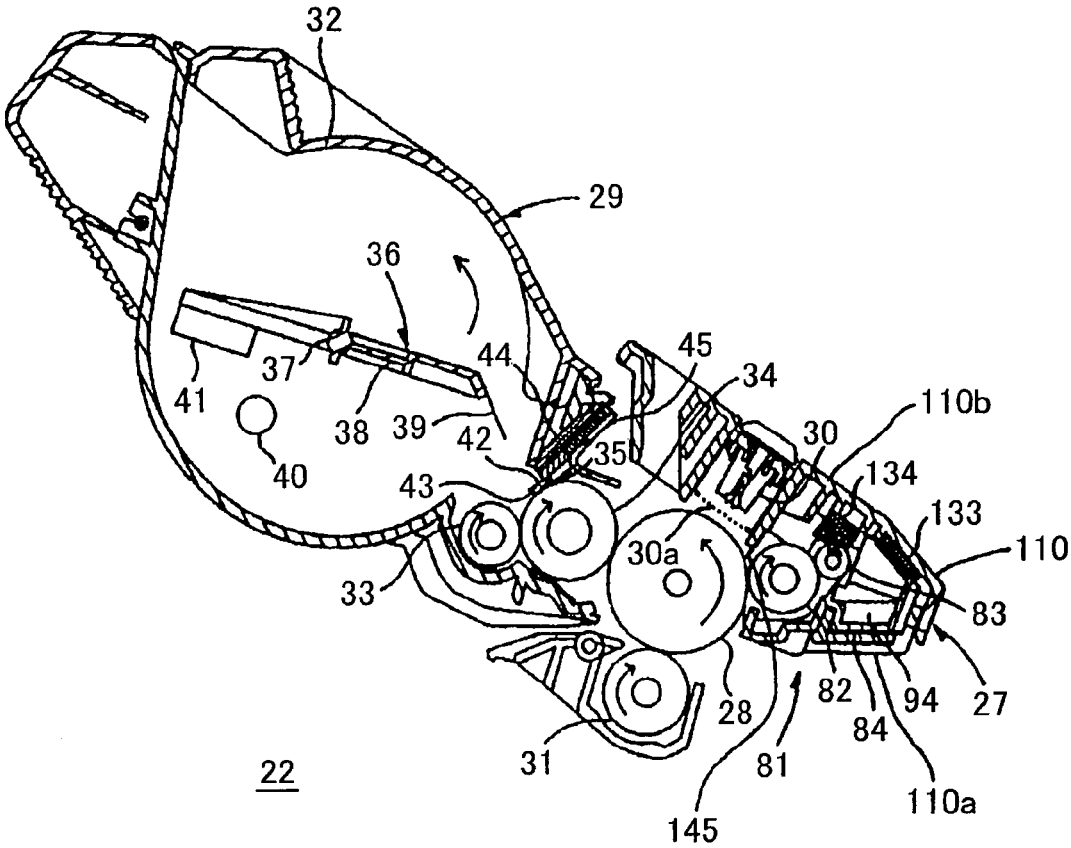
FIG. 2 is a cross-sectional view showing a process unit used in the image forming device according to the embodiment.

The process unit 22 is disposed below the scanner bst portion 21 and is provided detachable from the main casing 2. As best shown in FIG. 2, the process unit 22 includes a drum cartridge 27 functioning as a device to be electrically charged, and a developing cartridge 29. The drum cartridge 27 includes a drum frame 110, the photosensitive drum 28 functioning as a member to be charged, a scorotron charger 30, a transfer roller 31 and a cleaning unit 81 those assembled in the drum frame 110.

The developing cartridge 29 is detachable from the drum frame 110, and includes a toner hopper 32 a toner supply roller 33 positioned at one side of the toner hopper 32, a developing roller 34 and a toner layer thickness regulation blade 35.

In the toner hopper 32, positively chargeable non-magnetic single component type toners are filled as the developing agents. As the toners available are polymerization toners obtained by a conventional polymerization process such as suspension polymerization process in which styrene base monomer and polymerizable monomer such as acrylic acid, alkyl(C1–C4) acrylate and alkyl(C1–C4) methacrylate are copolymerized. The polymerization toners have spherical shape having average particle size of about 6 to 10 μm and provide excellent fluidity. A coloring agent such as a carbon black and a wax are added to the polymerization toners. Further, external additive such as silica is added to improve fluidity of the toners.

In the toner hopper 32 there is provided an agitator 36 including a rotation shaft 37 rotatably supported at a center portion of the toner hopper 32, an agitation blade 38 extending from the rotation shaft 37 in a radial direction, and a flexible member 39 fixed to or bonded to a free end of the blade 38. A cleaner 41 is provided at a diametrically opposite side of the blade 38 for wiping and cleaning a window 40 formed at one side wall of the toner hopper 32. A residual toner amount in the hopper 32 can be detected through the window 40. Upon rotation of the rotation shaft 37, the agitation blade38 is circularly moved about an axis of the shaft 37 so that the toner accumulated in the toner hopper 32 is scraped up by the flexible member 39. Thus, the toner is supplied to the toner supply roller 33. Simultaneously, the window 40 can be wiped out when the cleaner 41 passes therethrough.

The toner supply roller 33 is supported at one side of the toner hopper 32 and is rotatable in a direction opposite to the rotating direction of the agitator 36. The toner supply roller 33 includes a metallic roller shaft and an electrically conductive polyurethane sponge formed over the roller shaft.

The developing roller 34 is positioned beside the toner supply roller 33 and is rotatable in a direction the same as the rotating direction of the toner supply roller 33. The developing roller 34 includes a metallic roller shaft, an electrically conductive resilient layer formed over the roller shaft, and a coating layer formed over the resilient layer. The resilient layer contains an electrically conductive polyurethane rubber or a silicone rubber containing electrically conductive resilient material and carbon fine particles. The coating layer contains polyurethane rubber or a silicone rubber containing fluorine. The roller shaft of the developing roller 34 is connected to an electrical power source so that a predetermined level of developing bias is applied to the shaft. The toner supply roller 33 and the developing roller 34 are in confronting relation in such a manner that the toner supply roller 33 is in pressure contact with the developing roller 34. The surfaces of these rollers 33 and 34 are moved in opposite direction to each other at the contacting area.

The toner layer thickness regulation blade 35 is positioned immediately above the developing roller 34 and extends in an axial direction thereof. The regulation blade 35 is positioned along a rotational moving locus of the developing roller 34 from a confronting area between the toner supply roller 33 and the developing roller 34 to a confronting area between the developing roller 34 and the photosensitive drum 28. The regulation blade 35 includes a leaf spring 42, a pressure contact segment 43, a back-up member 44 and a support member 45. The pressure contact segment 43 is provided at a tip end of the leaf spring 42 and in contact with the developing roller 34. The segment 43 is formed of electrically insulative silicone rubber. The backup member 44 is provided at a rear side of the leaf spring 42. The support member 45 is adapted for suspending a rear end of the leaf spring 42 to the developing cartridge 29. In the toner layer thickness regulation blade 35, the pressure contact segment 43 is urged toward the surface of the developing roller 34 because of the biasing force of the leaf spring 42, while the leaf spring 42 is supported to the developing cartridge 29 by the support member 45.

The toner which have been delivered by the toner supply roller 33 are fed to the developing roller 34 upon rotation of the toner supply roller 33. At the time of toner transfer from the toner supply roller 33 to the developing roller 34, the toners are subjected to friction between these rollers 33 and 34 so that the toners are positively charged. The positively charged toners are carried on the surface of the developing roller 34 and are entered into a space between the developing roller 34 and the pressure contact segment 43 of the toner layer thickness regulation blade 35. When these toners are passed therebetween, the toners are further charged because of frictional force while a thickness of the toner layer is regulated. Thus, a thin toner layer is carried on the developing roller 34.

The drum frame 110 is constituted by a lower frame 110*a* and an upper frame 110*b* those formed of a resin. The photosensitive drum 28 is positioned beside the developing roller 34 and is rotatably supported by the lower frame 110*a*. The rotating direction of the photosensitive drum 28 is opposite to that of the developing roller 34. The photosensitive drum 28 includes an electrically grounded hollow cylindrical member made from aluminum and a photosensitive layer formed over the hollow cylindrical member. The photosensitive layer is made from positively chargeable material such as polycarbonate.

The scorotron charger 30 is attached to the upper frame 110*b*. The scorotron charger 30 is positioned out of contact from the photosensitive drum 28 with a predetermined distance when the upper frame 110*b* is attached to the lower frame 110*a* to assemble the drum frame 110. The charger 30 has a grid 30*a* described later.

The cleaning unit 81 is disposed at the upper frame 110*b* for temporarily trapping residual toners on the surface of the photosensitive drum after toner image transfer to the sheet and for collecting paper dust released from the sheet 3 to the surface of the photosensitive drum 28 during the toner image transfer to the sheet. The cleaning unit 81 includes a primary cleaning roller 82, a secondary cleaning roller 83 and a holder member 84 for holding these rollers 82,83. The holder member 84 is made from a resin and integrally provides a paper dust accumulating portion 94. When the upper frame 110*b* is attached to the lower frame 110*a*, the cleaning unit 81 is positioned at an opposite side of the developing roller 34 with respect to the photosensitive drum 28.

In accordance with the rotation of the photosensitive drum 28, the surface of the drum 28 is uniformly charged with positive polarity by means of the scorotron charger 30, and is subjected to exposure to laser beam emitted from the scanner portion 21 according to the print data, whereupon electrostatic latent image is formed on the photosensitive surface. Then, in accordance with the rotation of the developing roller 34, the toner carried on the developing roller 34 and charged with positive polarity is supplied to the exposed part of the photosensitive drum 28, the potential level of the exposed part being lower than that of the remaining part of the photosensitive drum surface uniformly positively charged. Thus, a visible toner image is formed on the photosensitive drum 28.

The transfer roller 31 is positioned immediately below the photosensitive drum 28. The transfer roller 31 is supported by the lower frame 110*a* and is rotatable in a direction opposite the rotating direction of the photosensitive drum 28. The transfer roller 31 includes a rotation shaft made of metal and connected to an electrical power source, and an electrically conductive rubber layer formed over the rotation shaft. A predetermined transfer bias voltage is applied to the rotation shaft for the toner transfer from the photosensitive drum 28 to the sheet 3.

In accordance with the rotation of the photosensitive drum 28, the visible toner image on the photosensitive drum 28 is transferred to the sheet when the sheet 3 delivered from the register roller 10 passes between the photosensitive drum 28 and the transfer roller 21 while the sheet 3 is in contact with the photosensitive drum 28. The sheet 3 carrying the toner image is then fed to the fixing portion 23 through a feed belt 46 bridging between the transfer roller 31 and the fixing portion 23.

The fixing unit 23 is positioned beside the process unit 22 and downstream side of the process unit 22. The fixing unit 23 includes a heat roller 47, a pressure roller 48 and a feed roller 49. The heat roller 47 has a metal sleeve in which a halogen lamp is installed as a heat source. The pressure roller 48 is positioned immediately below the heat roller 47 while pressing against the heat roller 47. The feed roller 49 is positioned downstream of the heat roller 47 and the pressure roller 48. The toner image transferred onto the sheet 3 is melted and fixed to the sheet 3 when the image carrying sheet passes through the heat roller 47 and the pressure roller 48. The sheet 3 is then delivered to a downstream side feed roller 50, a discharge roller 51 positioned above the downstream side feed roller 50, and a discharge tray 52.

A sheet re-circulation unit 61 is provided for forming images on both surfaces of the sheet 3. The re-circulation unit 61 includes a sheet reverse section 62 and a re-circulation tray 63 integrally therewith. The re-circulation unit 61 is positioned at a rear wall of the main casing 2 in such a manner that the sheet reverse section 62 is attached beside the rear wall, and the re-circulation tray 63 is detachably insertedly assembled into the rear wall at a position above the sheet tray 6. The sheet reverse section 62 has a casing 64 having a rectangular cross-section in which a pair of reverse rollers 66 and a pair of re-circulation rollers 67 are provided. A reverse guide plate 68 extends upwardly from an upper end portion of the casing 64.

A flapper 65 is provided at a downstream side of the feed roller 49 for switching a feeding direction of the one-sided image carrying sheet 3 fed by the feed roller 49 either to the downstream feed roller 50 as shown by a solid line or to the reverse roller pair 66 as shown by a broken line.

For printing an image on a back surface of the sheet 3 whose front surface has been formed with an image, the flapper 65 is switched to a position allowing the sheet 3 to be fed toward the reverse roller pair 66. Thus, the sheet 3 is received in the sheet reverse section 62. After the sheet 3 reaches the reverse roller 66, the reverse roller 66 is rotated in a normal direction for temporarily discharging the paper upwardly along the reverse guide plate 68. When a major part of the sheet 3 is fed out of the casing 64 and a trailing end portion of the sheet 3 is nipped between the reverse roller pair, the normal rotation of the reverse roller pair 66 is stopped.

Then, the reverse roller pair 66 are reversely rotated to feed the sheet 3 downwardly toward the re-circulation roller pair 67. A sheet sensor 76 is provided between the fixing portion 23 and the feed roller 49 for detecting a the sheet 3. A reverse timing for changing the rotating direction of the reverse roller 66 from the normal rotation to the reverse rotation is controlled such that the timing occurs after elapse of a predetermined period starting from a detection timing at which the sheet sensor 76 detects a trailing edge of the sheet 3. Further, the flapper 65 is switched to its original posture, i.e., a posture allowing the sheet to be fed to the downstream feed roller 50 from the feed roller 49 upon completion of feeding of the sheet to the reverse roller 66.

Then, the sheet 3 fed by the re-circulation roller pair 67 is delivered to the re-circulation tray 63. The re-circulation tray 63 has a sheet receiving portion 69, a tray 70 and diagonal feed rollers 71. The sheet receiving portion 69 is externally attached to the main casing 2 at a position below the sheet reverse section 62, and has an arcuate sheet guide member 72. The sheet 2 substantially vertically downwardly oriented from the re-circulation roller pair 67 can be oriented in a substantially horizontal direction along the curvature of the sheet guide member 72 toward the tray 70.

The tray 70 has a rectangular plate-like shape, and is oriented in a horizontal direction above the sheet tray 6. An upstream end of the tray 70 is connected to the sheet guide member 72, and a downstream end of the tray 70 is connected to an upstream end of a recirculation path guide 73 for feeding the sheet from the tray 70 to the feed roller 9. The recirculation path guide 73 has its downstream end directing toward the feed roller 9.

At a sheet path on the tray 70, two diagonally feed rollers 71, 71 are spaced away from each other in the sheet feeding direction. These diagonally feed rollers 71, 71 are adapted to feed the sheet in a direction for permitting the sheet to be in abutment with a reference plate (not shown). The reference plate is positioned at one widthwise edge area of the sheet. Each diagonally feed roller 71 includes a diagonal feed drive roller 74 whose rotation axis extends substantially perpendicular to the sheet feeding direction, and a diagonal feed driven roller 75 in nipping relation to the drive roller 74. A rotation axis of the driven roller 75 extends in a direction displacing from the direction perpendicular to the sheet feeding direction, but extends in a slanting direction for allowing the sheet to be brought into abutment with the reference plate.

The sheet 3 delivered from the sheet receiving portion 69 to the tray 70 moves toward the feed roller 9 through the recirculation path guide 73 while one widthwise edge of the sheet is in slidingly abutting relation to the reference plate. The sheet turned upside down is then fed to the image forming position through the register roller 10. The back surface of the sheet 3 is in confrontation with the photosensitive drum 28 for transferring a toner image to the back surface from the photosensitive drum 28. The toner image is then fixed at the fixing portion 23, and is then discharged onto the discharge tray 52.

Figure 5:
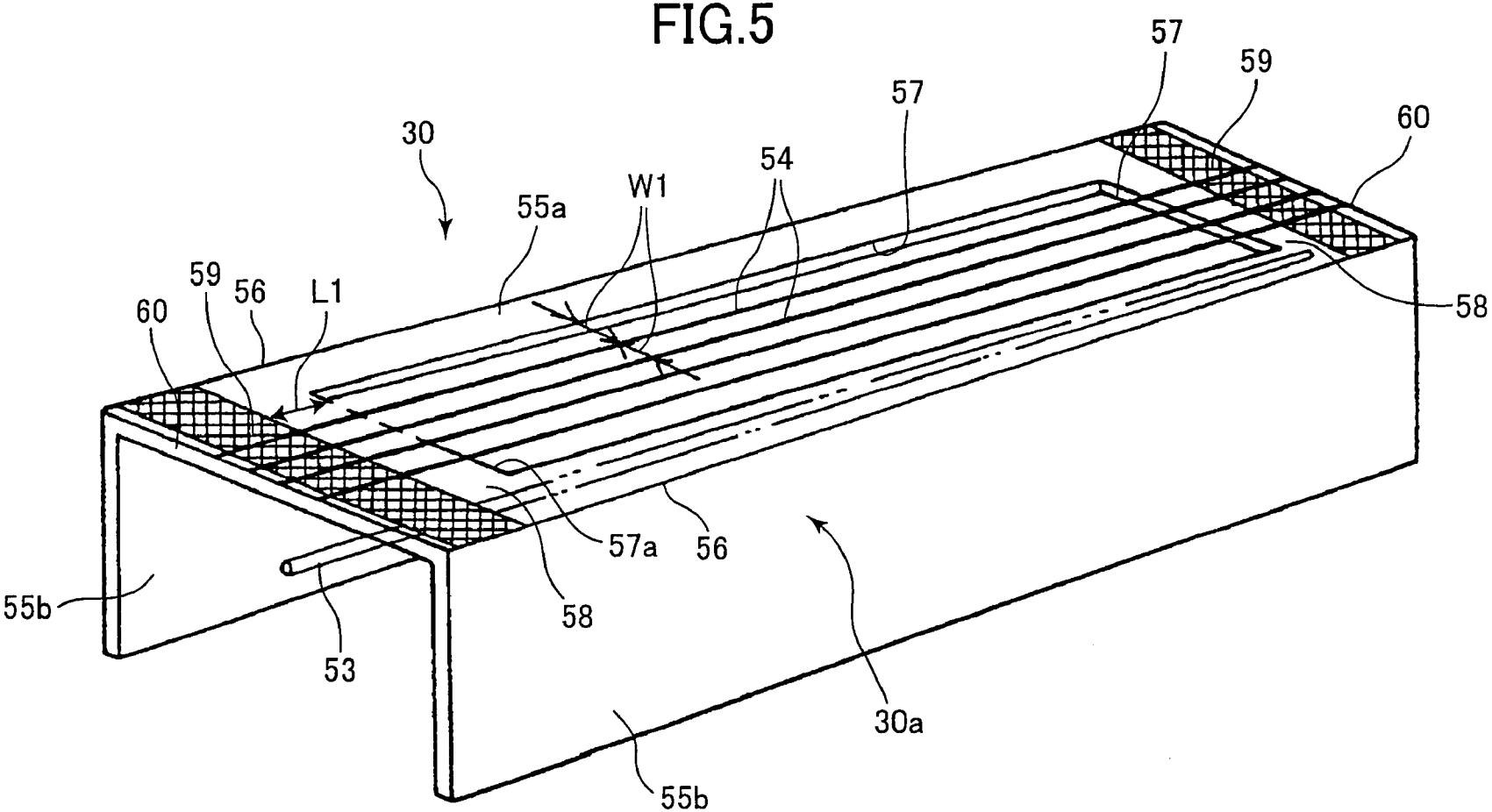
FIG. 5 is a perspective view showing a grid of a scorotron charger according to one embodiment of the present invention.
Figure 6:
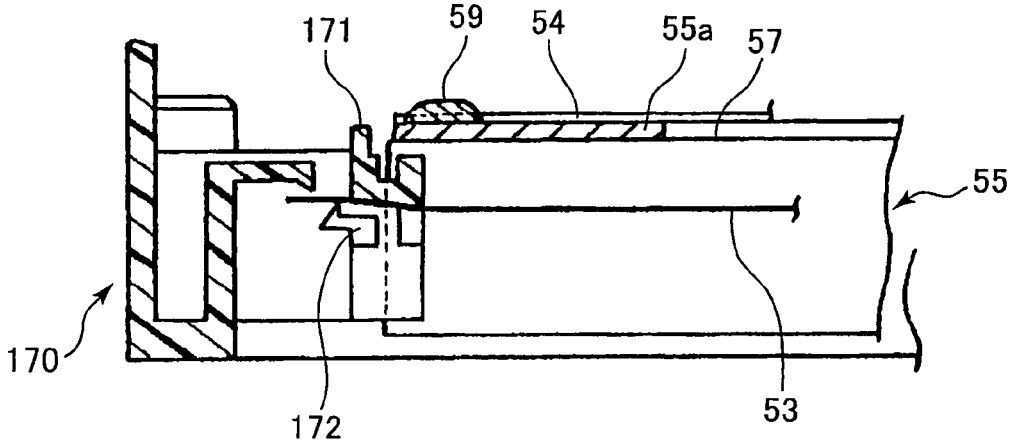
FIG. 6 is a cross-sectional view particularly showing one end portion of the scorotron charger.

A detail arrangement of the scorotron charger 30 will next be described. As shown in FIG. 5, the charger 30 has a discharge wire 53 made from tungsten wire plated with a gold, and a grid 30*a*. The grid 30*a* has a frame body 55 (55*a*, 55*b*, 55*c*) and grid wires 54. The frame body 55 is made from a material such as a stainless steel having a corrosion resistance against corona discharge from the discharge wire 53. The frame body 55 has a U-shape in cross-section having a main plate section 55*a* adapted to be in confrontation with the photosensitive drum 28 and to which the grid wires are attached. The frame body 55 also has left and right side plate sections 55*b* and 55*c* provided by perpendicularly bending a frame body member at bending lines 56, 56 extending in a direction parallel with the extending direction of the grid wires 54. Each grid wire has a circular cross-section.

The main plate section 55*a* is formed with a rectangular opening having a major side with a length of for example 230 mm and a minor side 57*a* with a length of 12 mm. The major side extends in a direction parallel with the discharge wire 53 and the length of the major side is greater than a maximum printing width on a maximum size sheet. The minor side 57*a* intersects the grid wires 54. The opening is formed by punching. At least the minor sides 57*a* intersecting the grid wires 54 are provided by punching which is performed from a side at which the grid wires 54 are attached to the main plate section 55*a*.

Each end portion of the grid wire 54 is fixed to the frame body 55 under tension at a side opposite to the discharge wire 53 with respect to the frame body 55 by soldering allowing electrical conduction therewith in such a manner that each grid wire 54 passes over the opening 57. Each end area of the main plate section 55*a* at which each end of the grid wire 54 is fixed will be referred to as a wire securing section 59. The wire securing section 59 is in the form of a flat plane encompassing each end portion of each grid wire 54.

The wire securing section 59 is displaced from the minor side 57*a* toward an edge 60 of the main plate section 55*a* by a distance L1. An area between the wire securing section 59 and the minor side 57*a* serves as a securing agent preventive area 58 for preventing a securing agent, i.e., soldering agent, from being entered into the opening 57. Incidentally, each end of each grid wire 54 is cut to be substantially flush with the edge 60 of the main plate section 55*a*.

The grid wires 54 have diameters of 300 μm and are arrayed with a predetermined pitch W1 of 1.3 mm measured between neighboring center axes thereof. In other words, a space between the neighboring grid wires has a width of 1 mm. Eight grid wires 54 are provided in the depicted embodiment. Each wire is secured to the frame body 55 with a predetermined tension which still allows the wire to be resiliently deformed. Typical tension level is 400 gf.

Grid wires 54 having diameter ranging from 30 μm to 350 μm are available. However, if a width of the space between the neighboring grid wires is greater than 1.0 mm, charge control to the photosensitive drum 28 by the grid wires 54 cannot be sufficiently performed. If the numbers of the grid wires 54 is increased, it becomes difficult to secure the grid wires to the main plate section 55*a*. In view of the above, in the present embodiment, the diameter of the grid wire 54 is determined to 300 μm, and grid pitch is set to 1.3 mm to provide the width of the space between the grid wires to 1.0 mm. As a result, enhanced charge control to the photosensitive drum 28 by the grid wires can result, and grid wires can be easily secured to the main plate section 55*a* with a proper numbers of the grid wires. Incidentally, the numbers of the grid wires is not limited to eight, but other appropriate numbers is conceivable taking the length of the minor side 57*a* of the opening 57 and diameter of the grid wire into consideration.

Next, a method for producing the grid 30*a* will be described. First, a flat stainless steel plate is shaped into U-shape in cross-section by pressing. During the pressing, the stainless plate is concurrently subjected to punching to form the opening 57. Thus, provided is the frame body 55 having the main plate section 55*a* formed with the opening 57, and left and right side plate sections 55*b*, 55*b* bent by 90 degrees with respect to the main plate section 55*a* defining the angled portion 56,56. Because these sections 55*a*, 55*b* are provided concurrently with the formation of the opening 57, improved relative positional accuracy among the opening 57 and angled portions 56, 56 can be provided.

As described above, the punching to the stainless plate is performed from a side where the grid wires 54 are secured to the main plate section 55*a*, otherwise fins due to the punching may protrude toward a surface to which the grid wires are to be secured. Since the grid wires 54 are placed in intersecting relation with the minor side 57*a* of the opening 57, the grid wires 54 may be in contact with these fins protruding from the minor sides 57*a*, which causes floating of the grid wires 57*a* from the surface of the main plate section 55*a*. Protruding amount or length of the fins protruding from the minor sides 57*a* are not uniform along the length of the minor sides 57*a*. Therefore, in the latter case, relative positional displacement may occur among the grid wires 54. Consequently, a charge control to the photosensitive drum 28 by the grid wires 54 may be degraded. To avoid this drawback, these fins protruding toward the grid securing surface must be removed by cutting or grinding. However, such removing work is time consuming and costly. In view of the reason, the punching must be performed from a side at which the grid wires 54 are to be secured so as to protrude the fins toward an side opposite to the wire-secure side.

In the depicted embodiment, bending work for bending a plate for forming the side plates 55*b*, 55*b* along the bending lines 56, 56 and the punching work for forming the opening 57 are simultaneously performed in order to provide dimensional accuracy of the opening with respect to the main plate section 55*a*. For performing punching with high accuracy, a portion around the opening 57 must be supported firmly. In this case, if a distance between a major side of the opening and the bending line 57*a* is sufficiently long such as about 2 mm or more, the punching can be performed from the side of the frame body 55 where the grid wires 54 are to be secured, because sufficiently large supporting space can be provided below the main plate section 55*a* for the punching. On the other hand, if high performance is required in a resultant a grid 30*a*, the minor side 57*a* of the opening 57 must be sufficiently long, which reduces the distance between the major side of the opening and the bending line 57*a*. In the latter case, the punching for forming the opening 57 is first performed from a side opposite to the wire securing side concurrently with the bending work for forming the side plates 55*b*, 55*b*. Thereafter, second punching is performed at the position adjacent to the minor sides 57*a* from the wire securing side of the main plate section 55*a* for removing the fins protruding toward the grid wire securing side. By the second punching, fins will protrude toward the side opposite to the grid wire securing side. Accordingly, grid wires 54 are not interfered with fins since the wires are not in direct contact with the fins. Consequently, grid wires 54 can be secured to the main plate section 55*a* with their correct positions.

Figure 7:
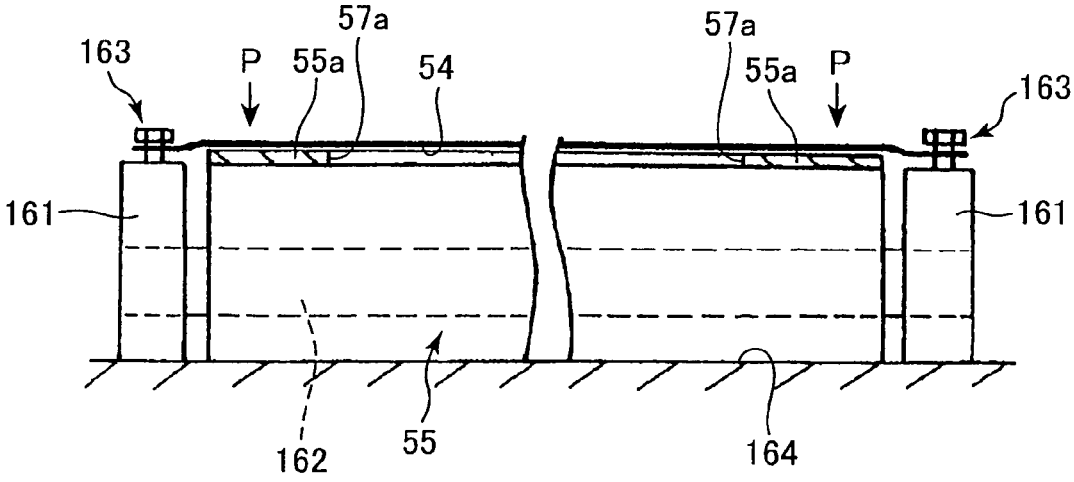
FIG. 7 is a side cross-sectional view for description of a method for producing the grid.

For securing the grid wires to the main plate section 55*a*, a jig shown in FIG. 7 is used. The jig includes a pair of blocks 161,161 spaced away from each other by a distance greater than a longitudinal length of the frame body 55, a pair of side beam plates 162, 162 connecting the blocks 161, 161 to each other, and wire holding members 163,163 such as bolt and nut each provided at each top surface of the block 161.

When the frame body 55 is placed into the jig placed on a table 164, the frame body 55 is subjected to positioning by being surrounded by the blocks 161,161 and side beam plates 162, 162. In this state, a vertical height of the wire holding member 163 from the table 154 is lower than a vertical height of the main plate section 55*a*. Then, eight grid wires are fixedly bridged between the wire holding members 163 and 163 with a predetermined tension. As a result, the eight grid wires 54 extend in parallel to one another with a predetermined pitch W1 along a surface of the main plate section 55*a*, and each end portion of each grid wire are in abutment with each edge 60 (FIG. 5) of the main plate section 55*a*. While maintaining this condition, grid wires are soldered to the main plate section 55*a* of the frame body 55 at a position spaced away by the distance L1 from the minor side 57*a* of the opening 57 toward the edge 60. Thus, eight grid wires 54 can be secured to the main plate section 55*a*.

Then, the grid wires 54 are released from the wire holding members 163 to remove the grid 30*a* out of the jig. In this state, each end portion of each grid wire 54 protrudes from the edge 60 of the main plate section 55*a*. Then each protruding end portion is cut by a cutter (not shown) along the edge 60. In this cutting, the cut end of the grid wire 54 is preferably positioned inside of the edge 60, for example, as shown at a left edge of a grid wire 654 and a left edge of a main plate section 655*a* of FIG. 13.

Figure 3:
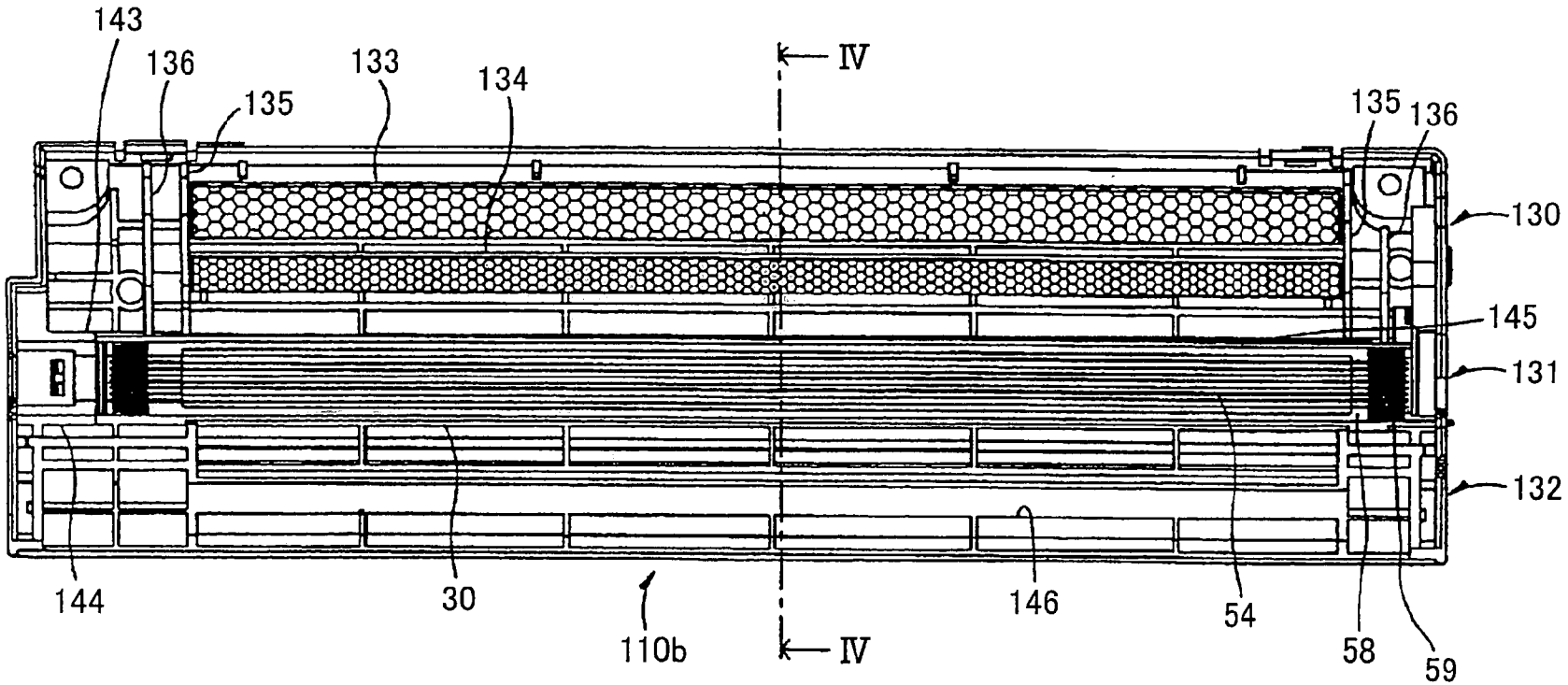
FIG. 3 is a bottom view of the process unit shown in FIG. 2.
Figure 4:
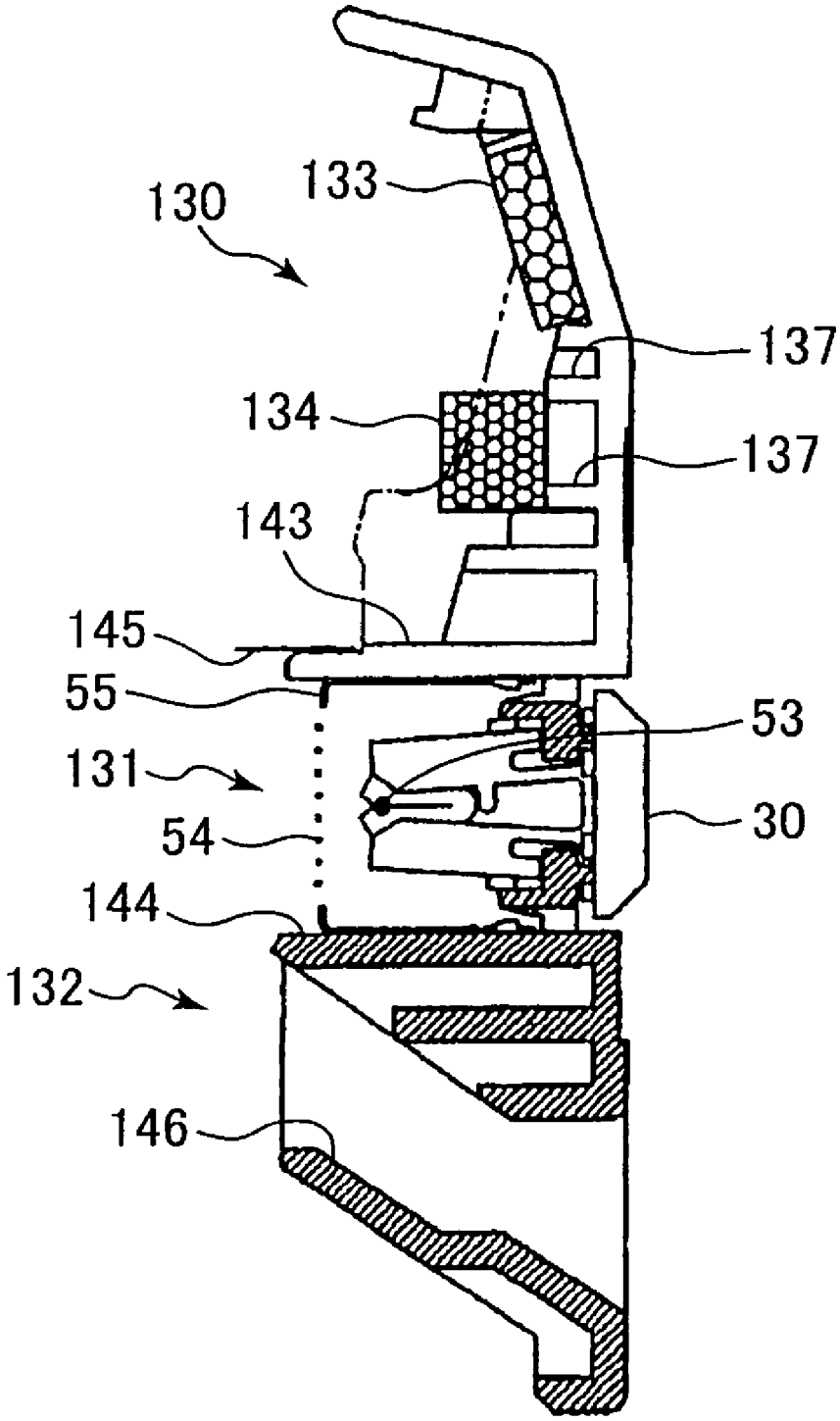
FIG. 4 is a cross-sectional view taken along the line IV-IV of FIG. 3.

Next, the discharge wire 53 and the grid 30*a* thus produced are attached to the upper frame 110*b* of the drum frame 110 to provide the scorotron charger 30. As shown in FIGS. 3 and 4, the upper frame 110*b* is in the form of a rectangular shape as viewed from its bottom, and includes a ceiling portion 130 for covering the cleaning unit 81, a charger support portion 131 for supporting the scorotron charger 30, and a laser beam passing portion 132 allowing the laser beam emitted from the scanner portion 21 to be irradiated onto the photosensitive drum 28. These portions 130, 131 and 132 are provided integrally.

The ceiling portion 130 has a lateral rib 137 extending in a widthwise direction of the sheet, a ceiling defining rib 135 extending in a sheet feeding direction, and upper support rib 136. A sponge seal 133 of the cleaning unit 81 is attached to the ceiling portion 130, and a sponge scraper 134 of the cleaning unit 81 is attached to the lateral rib 137.

The charger support portion 131 is positioned beside the ceiling portion 130, and includes a first support rib 143 and a second support rib 144 confronting therewith with a predetermined space therefrom. These first and second support ribs 143 and 144 extends in the widthwise direction of the sheet 3 and protrude downwardly. At each widthwise end of the charger support portion 131, an electrically insulative fixing portion 170 is provided for fixing thereto the frame body 55 of the grid 30*a*. The fixing portion 170 has an electrically insulating portion 171 and a locking portion 172 positioned therebelow and integrally therewith. Each end of the discharge wire 53 is locked at the locking portion 172. In the locking state of the discharge wire 53, the discharge wire 53 is located at approximately center position between the first and second support ribs 143 and 144 as shown in FIG. 4. The frame body 55 is inserted in a space defined between the first and second support ribs 143 and 144, so that the grid 30*a* can be fixed to the fixing portion 170. In this state, the edge 60 of the main plate section 55*a* is electrically isolated from the end portion of the discharge wire 54 by means of the insulating portion 171. Accordingly, unwanted corona discharge between the end of the grid wire 54 and the end of the discharge wire 53 can be prevented. The insulating portion 171 can be produced easily, because the insulating portion 171 can be formed during a molding process of the upper frame 110*b*.

The first support rib 143 has a lower end portion provided with an upper film 145 whose upper portion is bonded to a cleaning unit side of the rib 143. The upper film 145 extends along the extending direction of the film, i.e., widthwise direction of the sheet. The upper film 145 has an elongated rectangular shape and is made from a flexible resin film such as polyethylene terephthalate. The upper film 145 has a lower free end.

The laser beam passing portion 132 is positioned beside the charger support portion 131, and is formed with a through hole 146 serving as a laser beam passage extending obliquely downwardly.

In the scorotron charger 30 where the discharge wire 53 and the grid 30*a* are attached to the upper frame 110*b*, an imaginary vertical plane containing the discharge wire 53 and directing perpendicular to an imaginary plane containing eight grid wires 54 does not contain any one of the grid wire 54. Further, the grid wires 54 are symmetrically positioned with respect to the imaginary vertical plane, i.e., four grid wires are provided at one side of the imaginary vertical plane and another four grid wires are provided at the other side of the imaginary vertical plane.

After the upper frame 110*b* is attached to the lower frame 110*a*, the discharge wire 53 is in parallel with the rotation axis of the photosensitive drum 28, and the grid wires 54 are positioned between the photosensitive drum 28 and the discharge wire 53 and are spaced away from the photosensitive drum by a predetermined distance. A minimum distance between the photosensitive drum 28 and the grid wire 54 is set in a range of from 1 time to 2 time as large as a width of the space between the neighboring grid wires 54. In the illustrated embodiment, because the width of the space is 1 mm, the minimum distance is for example 2 mm.

The free end of the upper film 145 is slightly spaced away from the surface of the photosensitive drum 28 along a length thereof to avoid contact therewith. Since the upper film 145 is located between the primary cleaning roller 82 and the scorotron charger 30, the upper film 30 can prevent the paper dusts ambient the primary cleaning roller 82 from being adhered to the grid 30*a* of the scorotron charger 30. Consequently, desirable charging to the photosensitive drum 28 is attainable by the scorotron charger 30.

When the process unit 22 including the drum cartridge 27 and the developing cartridge 29 assembled thereto is installed into a given position of the laser printer 1, the discharge wire 53 is connected to a charging power source (not shown). Therefore, corona ion is discharged from the discharge wire 53 upon turning ON the power source. Further, the grid wires 54 are connected to a charge power source (not shown) so as to control a mode of charging on the photosensitive drum 28 provided by the corona ion released from the discharge wire 53 upon turning ON the power source. Corona ion released from the discharge wire 53 reaches the photosensitive drum 28 through the opening 57 of the grid 30 for charging the photosensitive drum 28. In this instance, the grid wires 54 control the charging mode on the drum 28 upon turning ON the power source connected to the grid wires 54.

In the illustrated embodiment, separate grid wires 54 are used as the grid electrodes. Instead of the grid wires 54, a grid electrodes pattern integral with a frame body may be conceivable by punching or etching method. However, with such methods, angle portions are provided at an intersection of sides of the grid electrode. As a result, corona ion discharged from the discharge wire 53 may be concentrated on the angle portion. In view of the above, separate grid wires 54 according to the present invention can provide charging efficiency superior to that of the grid electrodes produced by punching or etching, and predetermined voltage level on the surface of the photosensitive drum 28 can be promptly obtained in the present embodiment.

In order to investigate superiority of the scorotron charger 30 employing the grid wires 54 according to the embodiment to a scorotron charger using the punched out grid electrodes, comparative tests were performed. A charge control was made on a photosensitive drum 28 rotated at a low peripheral speed of 70 mm/s. In order to obtain a predetermined charge level on the photosensitive drum 28, necessary current level to the discharge wire 53 when employing the scorotron charger 30 of the present embodiment was two-third of that when employing the charger having the punched-out grid electrodes. Further, if the peripheral speed of the photosensitive drum was shifted to high speed such as 170 mm/s, charging to the photosensitive drum was not sufficiently controlled in case of the employment of the charger having the punched-out grid electrodes. On the other hand, charging to the photosensitive drum was sufficiently controlled in case of the employment of the scorotron charger 30 of the embodiment. Therefore, in the laser printer incorporating the scorotron charger 30, high image forming speed is attainable by increasing the peripheral speed of the photosensitive drum 28. The scorotron charger 30 is particularly available for the laser printer providing the peripheral rotation speed of the photosensitive drum not less than 100 mm/s.

As described above, in the grid 30*a* according to the present embodiment, the grid wires 54 are secured while applying tension thereto to the main plate section 55*a*, each end of the grid wire can be easily fixed to the main plate section 55*a*. Accordingly, a compact grid 30*a* results, and production cost of the grid can be greatly reduced. Further, because soldering is used for securing each grid wire to the main plate section 55*a*, easy production of the grid 30*a* can result. Furthermore, instead of soldering, electrically conductive adhesive agent can be used for fixing each end of the grid wire to the plate 155*a*.

Further, in the grid 30*a*, since the securing agent preventive area 58 for preventing a securing agent, such as the soldering agent and electrically conductive adhesive agent, from being entered into the opening 57 is provided between the wire securing section 59 and the opening 57, this area can avoid the entry of the securing agent into the opening 57. Accordingly, degradation of charging to the photosensitive drum 28 does not occur in the resultant scorotron charger 30.

Further, in the grid 30*a*, because the frame body 55 and the grid wires 54 are formed from a stainless steel, resultant product can be produced at low cost with excellent corrosion resistance and assembleability because of resiliency of the material. As corrosion resistant materials against corona discharge, tungsten steel and molybdenum steel are also available. Furthermore, tungsten steel and molybdenum steel can be used as the material of the grid wires 54. Moreover, corrosion resistance can further be improved if at least one metal selected from the group consisting of gold, silver, nickel, palladium and platinum is coated over the grid wire.

In the grid 30*a*, the frame body 55 has a simple construction and provides a sufficient rigidity capable of sustaining tension applied to the grid wires 54, because the frame body 55 has a U-shape cross-section in which left and right side plates 55*b*,55*b* are formed by bending along the elongated bending lines 56, 56 from the main plate section 55*a*, the lines extending in the extending direction of the grid wires 54.

Further, in the grid 30*a*, the minor side 57*a* of the opening 57, the minor side intersecting the grid wires 54, is punched from a side at which each end of the grid wire is secured to the main plate section 55*a*, any fins projecting from the minor side 57*a* extend toward a side opposite to the wire securing side. Accordingly, when the grid wires are secured to the main plate section 55*a*, the grid wires do not contact the fins, so that each grid wire can be positioned at its desirable position, thereby providing stabilized charging control to the photosensitive drum 28.

Further, because the scorotron charger 30 according to the depicted embodiment provides the above described improved grid 30*a* and the discharge wire 53, simplified and compact overall structure results to reduce production cost.

Further, in the scorotron charger 30 of the depicted embodiment, because the grid wires 54 are positioned opposite to the discharge wire 53 with respect to the main plate section 55*a*, the wire securing section 59 at each end of the grid wire 54 is not in direct confrontation with the discharge wire 53. This construction can avoid generation of unwanted corona discharge between the wire securing section 59 and the discharge wire 53 thereby stabilizing discharge performance.

Further, in the scorotron charger 30, the edge 60 of the main plate section 55*a* of the grid 30*a* is electrically isolated from the end of the discharge wire 53 because of the electrically insulating portion 171. Therefore, stabilized discharge performance can be obtained, since corona discharge between the end of the grid wire 54 and the end of the discharge wire 53 does not occur.

Further, in the scorotron charger 30, the imaginary vertical plane containing the discharge wire 53 and intersecting a horizontal imaginary plane containing eight grid wires 54 do not contain any one of the grid wires 54. The imaginary vertical plane implies a minimum path length of the corona ion from the discharge wire 53 to the photosensitive drum 28. Because no grid wire exists at the minimum path length, corona ion can be smoothly moved to the photosensitive drum 28 to enhance charging efficiency. Moreover, because even number of grid wires 54 are provided, such as eight wires, the numbers of wires positioned at one side of the imaginary vertical plane is equal to the numbers of the wires positioned at the other side of the vertical plane. This can also enhance the charge controllability.

Further, in the drum cartridge 27 equipped with the photosensitive drum 28, because the above described improved scorotron charger 30 is provided, the cartridge 27 has a compact size because of the compact structure of the scorotron charger 30. Because the drum cartridge 27 is detachable from the laser printer body, it can be easily replaced with a new drum cartridge if the scorotron charger 30 is contaminated with toners due to the repeated image forming operation.

Further, in the laser printer 1 of the present embodiment, because the improved compact drum cartridge is provided, resultant laser printer can also become compact.

Figure 8:
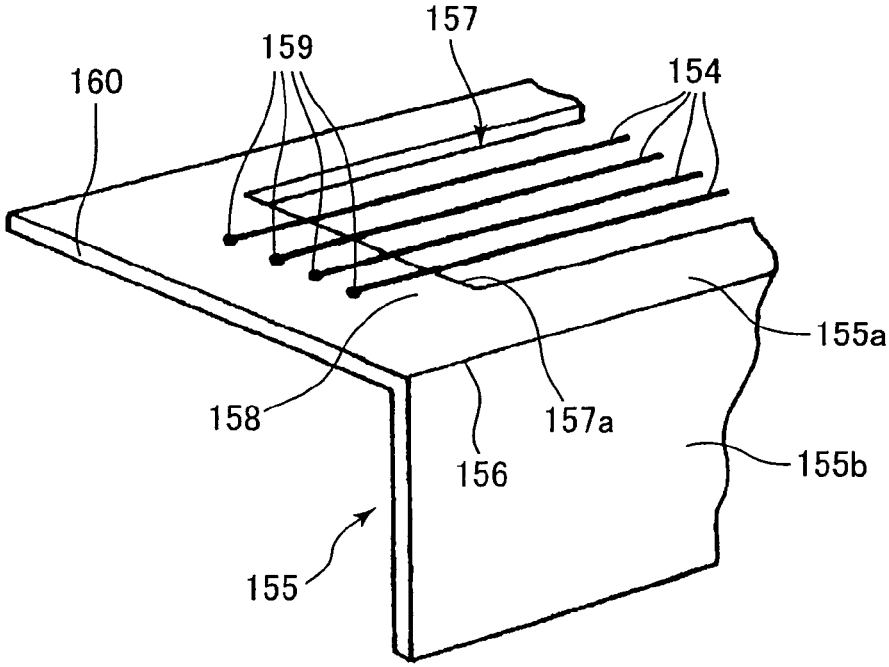
FIG. 8 is a partial perspective view showing a grid according to a second embodiment of the present invention.

FIG. 8 shows a grid according to a second embodiment. In the second embodiment, a frame body 155 is not U-shape in cross-section but an L-shape in cross-section having a main plate section 155*a* and a single side plate 155*b*. Further, in the second embodiment, instead of soldering, fuse bonding is performed for fixing grid wires 154 to the main plate section 155*a*, which can also facilitate production. Fuse bonding is superior to soldering in terms of mass production. For example, as shown in FIG. 8, a plurality of wire securing sections 159 are provided independently of each grid wire 154 in case of the spot welding. Furthermore, a concaved or convexed reinforcing rib (not shown) can be formed at the main plate section 155*a* and the side plate section1 155*b* so as to improve rigidity to obviate deformation in order to sustain tension applied to the frame body 155 by the grid wires 154.

Figure 9:
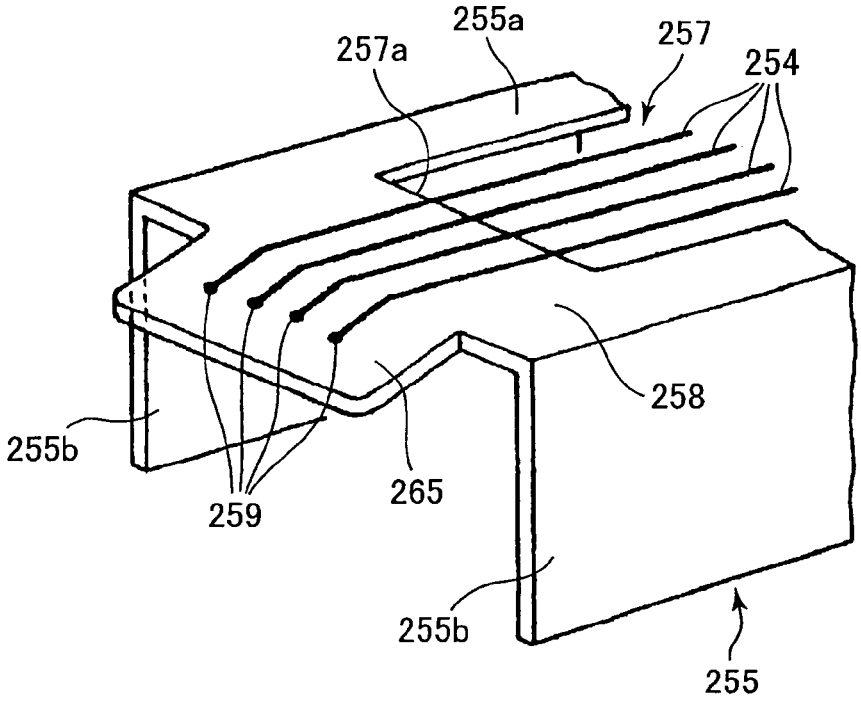
FIG. 9 is a partial perspective view showing a grid according to a third embodiment of the present invention.

FIG. 9 shows a grid 230*a* according to a third embodiment. A main plate section 255*a* of a frame body 255 integrally provides a protruding portion 265 protruding in a grid wire extending direction. The protruding portion 265 functions as a tension adjusting portion. Each end of the grid wire 254 is secured to the protruding portion 265 at the wire securing portions 259. Then, the protruding portion 265 is bent toward a side opposite to a wire securing side in order to increase tension of the grid wires 254. Reversely, if the protruding portion is bent toward the wire securing side, tension of the grid wires 254 can be lowered. In this way, the by controlling bending amount and bending direction of the protruding portion 265, a desirable tension can be imparted on the grid wires 254.

Figure 10:
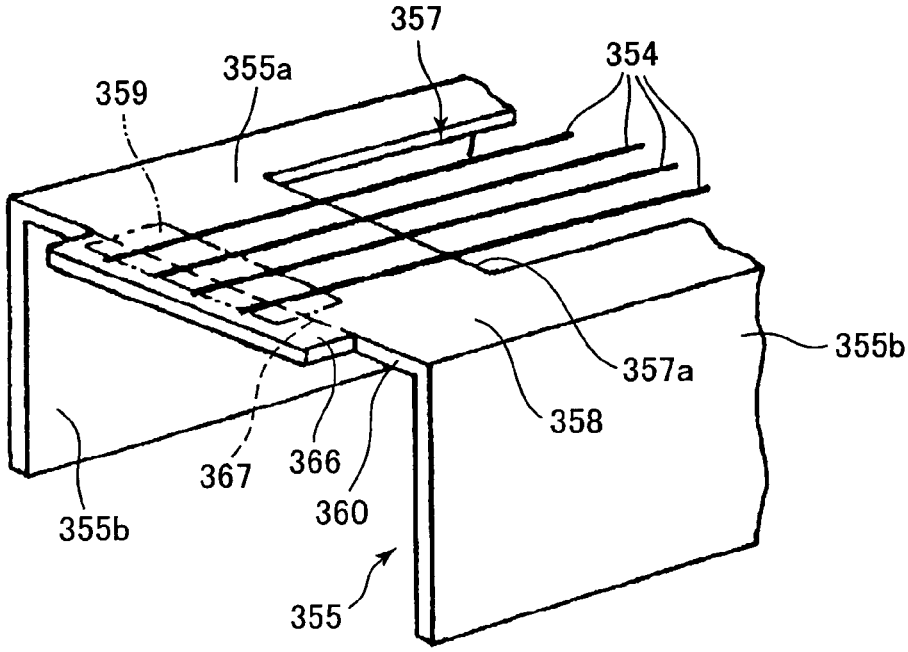
FIG. 10 is a partial perspective view showing a grid according to a fourth embodiment of the present invention.

FIG. 10 shows a grid 330*a* according to a fourth embodiment. In the fourth embodiment, a projecting segment 366 integrally projects from each edge 360 of a main plate section 355*a* of a frame member 355 in an extending direction of the grid wires 354. (In FIG. 10 only one side is shown). Then each end portion of the grid wire 354 is secured at a wire securing portion 359. The wire securing portion 359 are located on the surface of the main plate section 355*a* adjacent the edge 360 and on the projecting segment 366. After securing the grid wires 354, the projecting segment 366 is cut at a line 367 which is an extension of the edge 360. With such a cutting, each grid end does not project out of the edge 360. Accordingly, corona discharge between the end of the grid wire 354 and end of the discharge wire does not occur to thus stabilize the charging performance.

Figure 11A:
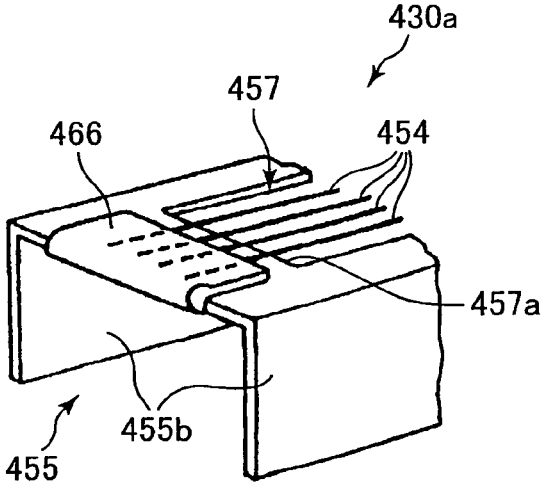
FIG. 11(*a*) is a partial perspective view showing a grid according to a fifth embodiment of the present invention.
Figure 11B:
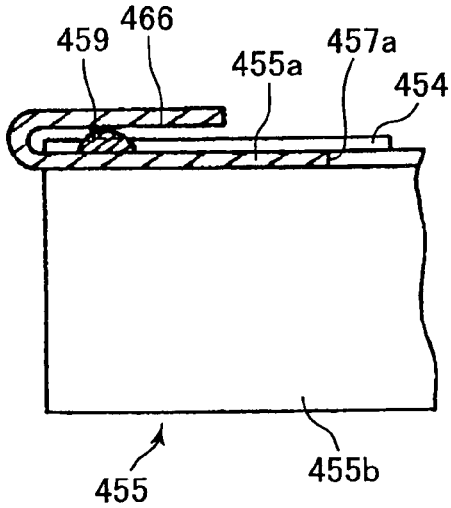

FIGS. 11(*a*) and 11(*b*) show a fifth embodiment of a grid 430*a*. The fifth embodiment is similar to the fourth embodiment, except that a projecting segment 466 corresponding to the projecting segment 366 of the fourth embodiment is not subjected to cutting, but is folded along an imaginary line which is an extension of an edge 460 in such a manner that the folded projecting segment 466 covers each end portion of the grid wires 454. Thus, the folded segment 466 serves as electrical discharge preventive member. In FIGS. 11(*a*) and 11(*b*), 455 designates a frame body, 455*b* side plate segments, 457 opening, 457*a* a minor side of the opening, and 459 a wire securing section.

Figure 12:
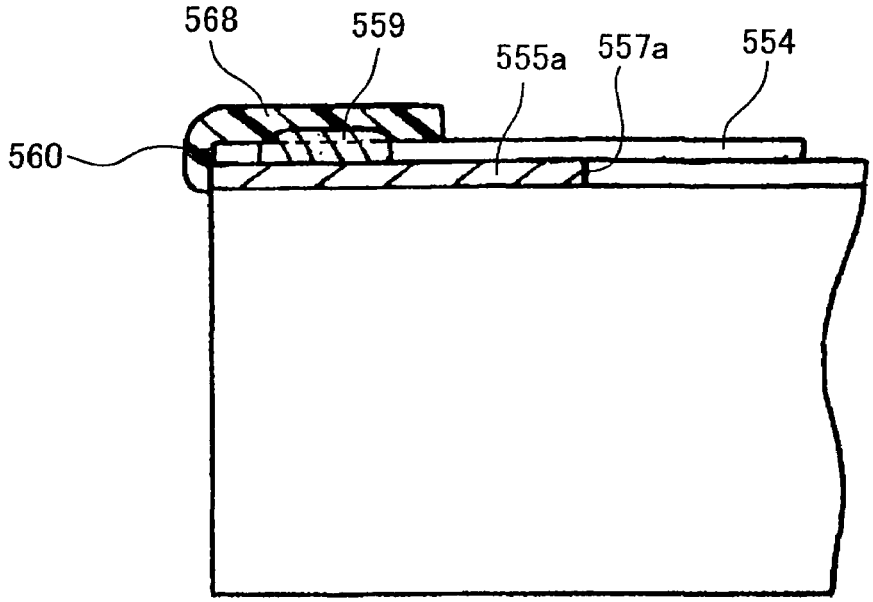
FIG. 12 is a partial cross-sectional view showing a grid according to a sixth embodiment.

In a sixth embodiment shown in FIG. 12, each end portion of grid wires 554 and main plate section 555*a*, and a wire securing portion 559 and a part of an edge 560 of a main plate segment 555*a* are covered with an adhesive agent 568 made from an electrically insulative resin. The adhesive agent 568 serves as an electric discharge preventive part.

Figure 13:
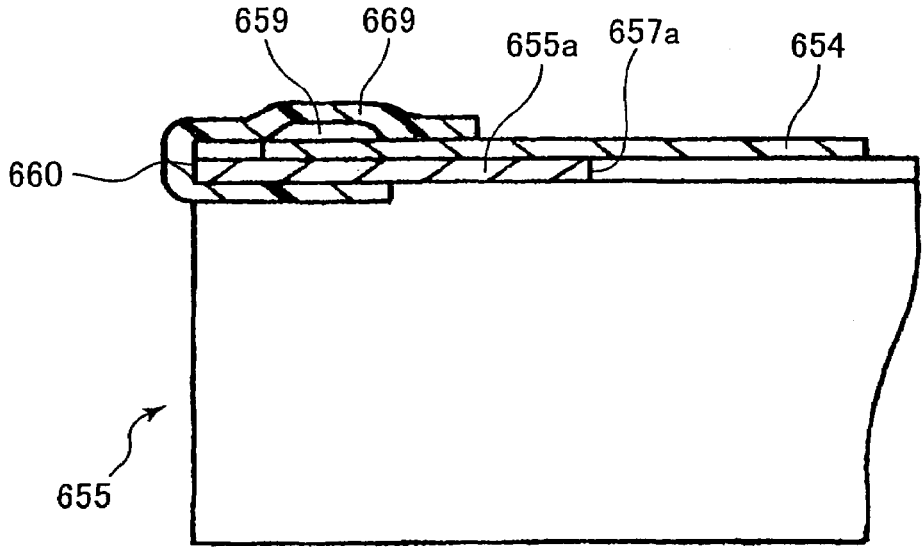
FIG. 13 is a partial cross-sectional view showing a grid according to a seventh embodiment.

In a seventh embodiment shown in FIG. 13, instead of the adhesive agent 568 used in the sixth embodiment, an electrically insulative adhesive tape 669 is attached over the portion corresponding to the adhesive agent area as well as a lower surface portion of the main plate section 655*a*. The tape 669 serves as an electric discharge preventive member. Alternatively, a resilient clip member having U-shape cross-section can be used instead of the adhesion of the adhesive tape 669. The clip can be easily provided by simply inserting the end portion of the grid wire and the main plate section 555*a* into a space of the U-shaped clip.

While the invention has been described in detail and with reference to the specific embodiments thereof, it would be apparent to those skilled in the art that various changes and modifications may be made therein without departing from the spirit and scope of the invention. For example, in the above-described embodiments, the frame body is formed of stainless steel. However, the frame body can be made from a material other than a metal or electrically conductive material. However, in the latter case, the discharge wire 53 must provide an electrode for generating corona discharge, and further, the electrically conductive wire securing section must be connected to an external circuit through a separate terminal or a lead line. Further, the scorotron charger 30 can be charged with negative polarity, and is available as an image transfer unit.

What is claimed is:

1. A scorotron charger for charging a photosensitive member comprising:

a grid comprising a frame body formed with an opening and made from a metal, and a plurality of grid wires each extending over the opening and having end portions directly fixed to the frame body; and a discharge wire positioned separate from the plurality of grid wires.

2. The scorotron charger as claimed in claim 1, wherein the discharge wire has each end fixed to the frame body, and the charger further comprising an insulating member disposed between each end of the discharge wire and each end of the grid wire.

3. The scorotron charger as claimed in claim 1, wherein the discharge wire extends in parallel with the plurality of grid wires, and wherein an imaginary vertical plane containing the discharge wire intersects perpendicularly to an imaginary horizontal plane containing the plurality of grid wires, none of the plurality of grid wires being contained in the imaginary vertical plane.

4. The scorotron charger as claimed in claim 3, wherein the number of grid wires is an even number, and the number of the grid wires positioned at one side of the imaginary vertical plane is equal to the number of the grid wires positioned at another side of the imaginary vertical plane.

5. The scorotron charger as claimed in claim 1, wherein the frame body has a front surface and a rear surface, the plurality of grid wires being positioned at the front surface, the discharge wire being positioned in confrontation with the rear surface and at a side opposite to the grid wires with respect to the frame body.

6. The scorotron charger as claimed in claim 1, wherein each end portion of each grid wire is fixed to the frame body by soldering.

7. The scorotron charger as claimed in claim 1, wherein each end portion of each grid wire is fixed to the frame body by fuse-bonding.

8. The scorotron charger as claimed in claim 1, wherein the frame body has a front surface and a rear surface, the plurality of grid wires being positioned at the front surface.

9. The scorotron charger as claimed in claim 8, wherein the discharge wire is positioned in confrontation with the rear surface of the frame body, the grid wires being positioned opposite to the discharge wire with respect to the frame body.

10. The scorotron charger as claimed in claim 1, wherein the frame body and the grid wires are formed from a stainless steel.

11. A process unit comprises a drum cartridge detachable from a printer body, the drum cartridge comprising:

a drum frame;

a photosensitive member rotatably supported by the drum frame; and a scorotron charger assembled in the drum frame and positioned out of contact from the photosensitive member, the scorotron charger comprising a grid comprising a frame body formed with an opening and made from a metal, and a plurality of grid wires each extending over the opening and having end portions directly fixed to the frame body; and, a discharge wire positioned opposite to the photosensitive member with respect to the plurality of grid wires.

12. The process unit as claimed in claim 11, further comprising a transfer roller positioned in confrontation with the photosensitive drum and rotatably supported by the drum frame, and a cleaning unit in contact with the photosensitive drum and assembled in the drum frame.

13. The process unit as claimed in claim 11, wherein the process unit further comprises a developing cartridge detachably attachable to the drum frame, the developing cartridge comprising a toner hopper for accommodating toners, a toner agitator for agitating the toner in the toner hopper, a developing roller in confrontation with the photosensitive drum when the developing cartridge is attached to the drum frame, and a regulation blade in contact with the developing roller.

14. The process unit as claimed in claim 11, wherein the frame body has a front surface and a rear surface, the plurality of grid wires being positioned at the front surface, the discharge wire being positioned in confrontation with the rear surface and at a side opposite to the grid wires with respect to the frame body.

15. The process unit as claimed in claim 11, wherein each end portion of each grid wire is fixed to the frame body by soldering.

16. The process unit as claimed in claim 11, wherein each end portion of each grid wire is fixed to the frame body by fuse-bonding.

17. The process unit as claimed in claim 11, wherein the frame body has a front surface and a rear surface, the plurality of grid wires being positioned at the front surface.

18. The process unit as claimed in claim 17, wherein the discharge wire is positioned in confrontation with the rear surface of the frame body, the grid wires being positioned opposite to the discharge wire with respect to the frame body.

19. The process unit as claimed in claim 11, wherein the frame body and the grid wires are formed from a stainless steel.

* * * * *